US007394022B2

(12) United States Patent
Gumley

(10) Patent No.: US 7,394,022 B2
(45) Date of Patent: Jul. 1, 2008

(54) ELECTRICAL WIRE CONNECTOR WITH TEMPORARY GRIP

(76) Inventor: Markus Gumley, 8619 Semiahmoo Dr., Blaine, WA (US) 98230

( * ) Notice: Subject to any disclaimer, the term of this patent is extended or adjusted under 35 U.S.C. 154(b) by 0 days.

(21) Appl. No.: 11/493,626

(22) Filed: Jul. 27, 2006

(65) Prior Publication Data

US 2008/0023224 A1 Jan. 31, 2008

(51) Int. Cl.
*H01R 4/18* (2006.01)

(52) U.S. Cl. ..... 174/84 C

(58) Field of Classification Search ..... 174/84 C, 174/88 R

See application file for complete search history.

(56) References Cited

U.S. PATENT DOCUMENTS

| | | | | | |
|---|---|---|---|---|---|
| 2,674,647 | A | * | 4/1954 | Dibner | 174/87 |
| 2,802,257 | A | * | 8/1957 | Holtzapple | 29/862 |
| 3,110,755 | A | * | 11/1963 | Esser | 174/87 |
| 3,281,524 | A | * | 10/1966 | Lynch, Jr. et al. | 174/84 C |
| 3,538,240 | A | * | 11/1970 | Sherlock | 174/88 R |
| 3,732,528 | A | * | 5/1973 | Vetter | 439/489 |
| 4,801,277 | A | | 1/1989 | Seilhan | |
| 5,114,359 | A | | 5/1992 | Chishima et al. | |
| 5,211,570 | A | | 5/1993 | Bitney | |
| 5,422,438 | A | * | 6/1995 | Lamome | 174/84 C |
| 5,480,315 | A | | 1/1996 | Martinelli | |
| 5,800,195 | A | | 9/1998 | Endo et al. | |
| 6,010,348 | A | | 1/2000 | Alden | |
| 6,135,800 | A | | 10/2000 | Majors | |
| 6,838,620 | B2 | * | 1/2005 | Murakami et al. | 174/84 C |
| 6,957,972 | B2 | | 10/2005 | Starke et al. | |
| 2002/0096353 | A1 | * | 7/2002 | Hanazaki et al. | 174/84 C |

* cited by examiner

*Primary Examiner*—Chau N Nguyen
(74) *Attorney, Agent, or Firm*—Edell, Shapiro & Finnan, LLC

(57) ABSTRACT

An electrical connector includes a crimpable tubular body including a receiving portion for receiving a wire conductor via an opening at a longitudinal end of the tubular body. The tubular body provides a permanent electrical connection to the wire conductor only upon at least a portion of the tubular body being crimped. The receiving portion has a tapered shape and inward projections for engaging the wire conductor to provide sufficient frictional force to resist removal of the wire conductor from the receiving portion prior to crimping, without providing a permanent electrical connection between the tubular body and the wire conductor. In one implementation, the electrical connector is a butt connector with two such receiving portions for splicing together two wires. In another implementation, the electrical connector is a ring connector that terminal on the other end with a washer-like disk that can be secured to a terminal.

10 Claims, 4 Drawing Sheets

ELECTRICAL WIRE CONNECTOR WITH TEMPORARY GRIP

FIELD OF THE INVENTION

The present invention relates to a connector for attaching a conductor of a wire to another conductor of a wire or to an electrical device. More particularly, the connector can be a butt connector or ring connector that receives and temporarily holds an electrical conductor in place within the connector in order to more easily crimp the connector onto the conductor to form a permanent connection.

BACKGROUND OF THE INVENTION

In many electrical and electronic environments, it is often necessary to splice two electrical wires together. Splices may be required when one or more wires are broken and must be reconnected or when an electrical component is being replaced with a different component. For example, a butt connector is typically used in line with two wires to spice the wires together. The butt connector is configured as a substantially cylindrical tube with two ends that respectively receive the two wires to be connected. Upon crimping the butt connector, the two wires are permanently spiced together. A ring connector has a first end that is similar to one end of a butt connector, which can be permanently secured to the end of a wire via crimping. The other end of the ring connector terminates in a flat, disk-like ring that can be affixed to an electrical terminal with a threaded nut or the like. In each case, a person securing the wire(s) to the connector must simultaneously control the position of the wire ends, accurately position the wire ends within the connector, and manipulate a crimping tool around the electrical connector to complete the connection.

A number of common work site situations can further complicate such splicing operations. It can be difficult to keep wires in a desired position, and simultaneously coordinating the positions of two wires, a butt connector, and a crimping tool can be challenging, particularly in tight spaces. Furthermore, because wires are generally considered to be unsightly, they are frequently located in hard to reach locations resulting in limited access to already difficult to handle wiring. For example, motorized equipment and vehicles, such as automobiles and boats, may require splicing of wires that are situated in tight, hard-to-reach places where manipulating of wires, connectors, and tools is problematic.

There is therefore a long felt need for an electrical connector that includes features which enable a splice or connection to be more easily performed even in the above-mentioned adverse situations. More specifically, an electrical connector is needed that allows wires to be more easily positioned in the connector even when the wires are unwieldy and even when the splicing must be performed in a limited access situation.

SUMMARY

Generally, the present invention relates to an electrical connector for connecting a conductor of a wire to another conductor or to an electrical device. The electrical connector includes an elongated body member having a center and at least one terminal end and includes an opening in the at least one terminal end. The opening is tapered and the surface of the opening includes ridges thereon that may be formed as female threading. The opening, therefore, has tapered threading therein. The opening is tapered from a larger diameter at the terminal end to a smaller diameter toward the center of the elongated body member.

The present invention allows a conductor of a wire to be easily, electrically connected to another wire or to another electrical component. To make the connection, the wire is first prepared by stripping the external insulation from the inner conductor on the end of the wire. The wire is then inserted into one of the openings in a terminal end of the electrical connector so that the conductor of the wire enters the opening and engages the ridges on the surface of the tapered opening. The insertion of the conductor into the tapered opening causes the conductor to be wedged in the tapered opening such that the surface of the opening resists removal of the conductor from the tapered opening. In the case of connecting two wires, a second wire can be inserted into another end of the electrical connector until the second conductor is also wedged in the tapered opening by a force resisting removal from the tapered opening.

The resisting forces hold the wire conductors in place in their respective tapered openings until a user applies a force to the external surface of the electrical connector with a crimping tool to more permanently secure the wedged conductors. In other words, the frictional resistive force provided between the conductors of the wire and the tapered opening prevents the conductors from being dislodged until a more permanent connective force is supplied by crimping. The crimping of the electrical connector provides the final connection between the wires and the electrical connector and thus the wires themselves. In the crimped state, the ridges or threading provide additional gripping that makes the permanent connection more rugged than conventionally.

The temporary wedging or gripping force of the tapered ridges resists removal of the conductors from tapered opening and simplifies the process of coupling wires via crimping by preventing wires from becoming dislodged from the connector prior to crimping. For example, in the case of reconnecting two broken conductors by splicing with a butt connector embodiment of the invention, a user need only wedge the first wire conductor into the tapered opening (which temporarily hold itself thereafter), wedge the second wire conductor in the second tapered opening (which will also hold itself temporarily thereafter), then (with one hand) crimp the ends of the electrical connector permanently onto the wire conductors.

Because the material of the electrical connector is conductive, an insulating sheath is provided around the electrical connector. The insulating sheath extends past the terminal ends of the electrical connector. Optionally, when a wire is inserted into the tapered opening, the conductor portion of the wire may enter the tapered opening and engages the inner surface if the tapered opening. At the same time, the external insulator portion of the wire enters and internally overlaps the portion of the insulating sheath that extends past the terminal end of the electrical connector. The overlap ensures that electrical flow through the spliced wires and electrical connector will be confined within the insulation of the wire and within the insulating sheath placed over the electrical connector.

BRIEF DESCRIPTION OF THE DRAWINGS

Like reference numerals have been used to identify like elements throughout this disclosure.

DETAILED DESCRIPTION

Figure 1:
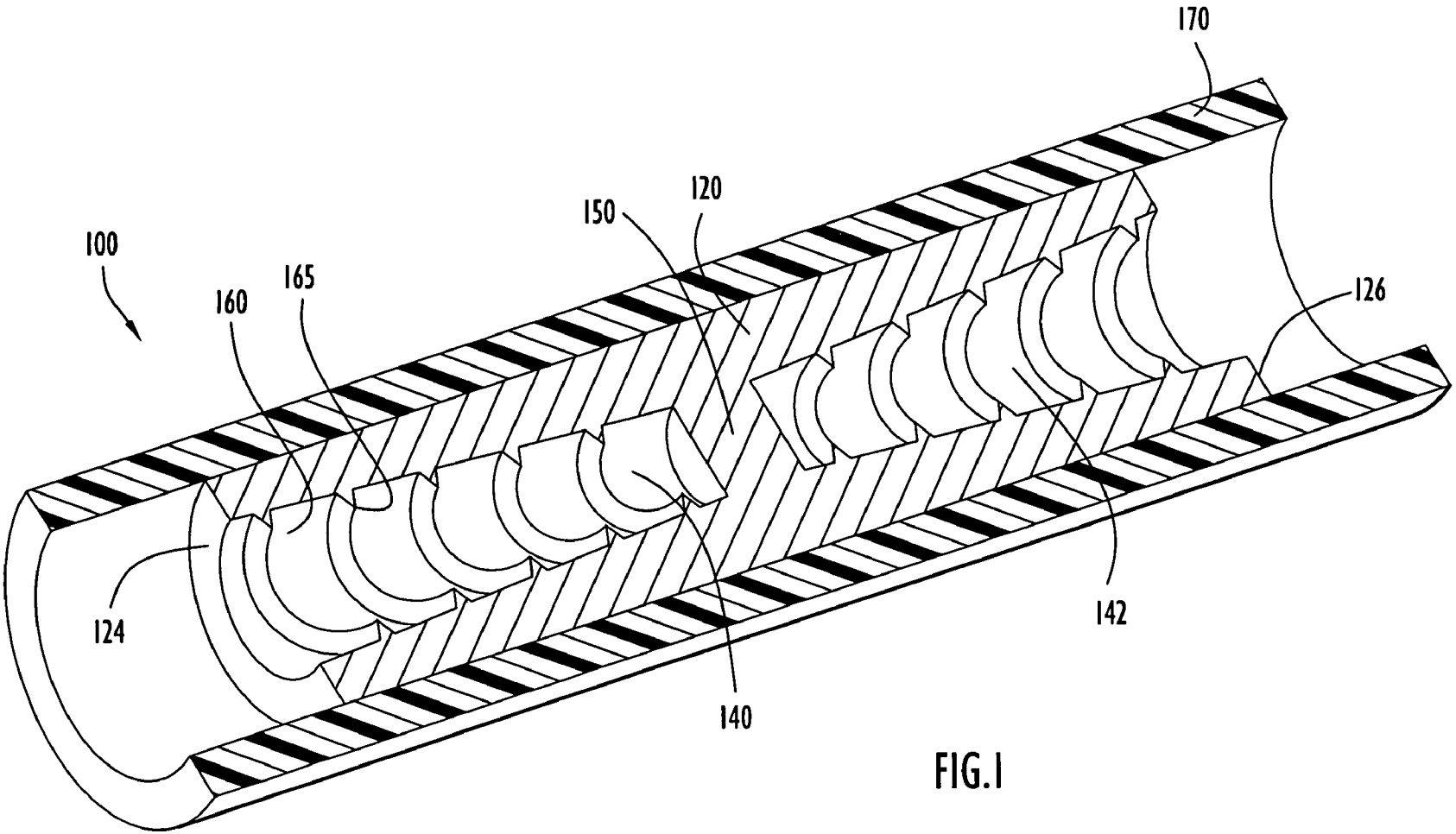
FIG. 1 illustrates a perspective cut-away view of a butt (splice) connector with tapered, ridged terminals according to an exemplary first embodiment of the invention.

Exemplary embodiments of the wire connector of the present invention will now be described in detail. The features of the wire connector will be discussed with reference to FIGS. 1-5. The figures are drawn to illustrate various aspects of the invention, and it will be appreciated that the features shown in the drawings are not necessarily to scale. For example, the figures are drawn to accentuate the tapered shape of the connector openings and the ridge structures therein to illustrate how these features facilitate a frictional engagement between wire conductors and the connector.

FIG. 1 illustrates a perspective cut-away view of a butt (or "splice") connector 100 according to a first exemplary embodiment of the present invention. Connector 100 comprises an electrical connector 120 and an insulating sheath 170 that surrounds the electrical connector 120. The electrical connector 120 comprises a substantially tubular, elongated conductive member including longitudinal terminal ends 124, 226. While shown in the figures with a substantially cylindrical shape, in general, the connector of the present invention can have virtually any traverses cross sectional shape (e.g., cylindrical (round), rectangular, star shaped, etc.). Each terminal end 124, 126 includes a tapered cavity or "receiving portion 140, 142. designed to receive and retain wire conductors. The receiving portions 140, 142 are tapered to be larger toward the terminals end 124, 126 and smaller toward the center of the electrical connector 120 near a central stop 150. The stop 150 is the portion of the electrical connector 120 located between the tapered receiving portions 140, 142 toward the center of the electrical connector 120 against which the conductors butt to limit insertion, in the event the conductors extend to the inward end of the receiving portions. The stop may be a continuous, solid boundary, as shown in the figures, or may be an opening partially blocked by protrusions that extend radially inward. The latter implementation may facilitate easier crimping of the connector in the case where the entire connector is crushed in the crimping process (as opposed to only the ends of the connector). The exterior of the electrical connector 120 is covered with the insulating sheath 170 for safely containing current passing through the electrical connector 120. As shown in FIGS. 1-4, the insulating sheath extends beyond the terminal ends 124, 126 of the electrical connector 120 to ensure overlap with the insulating sheaths of the wires to be secured. Thus, the electrical connector 120 and the insulating sheath 170 constitute the butt connector 100.

Figure 2:
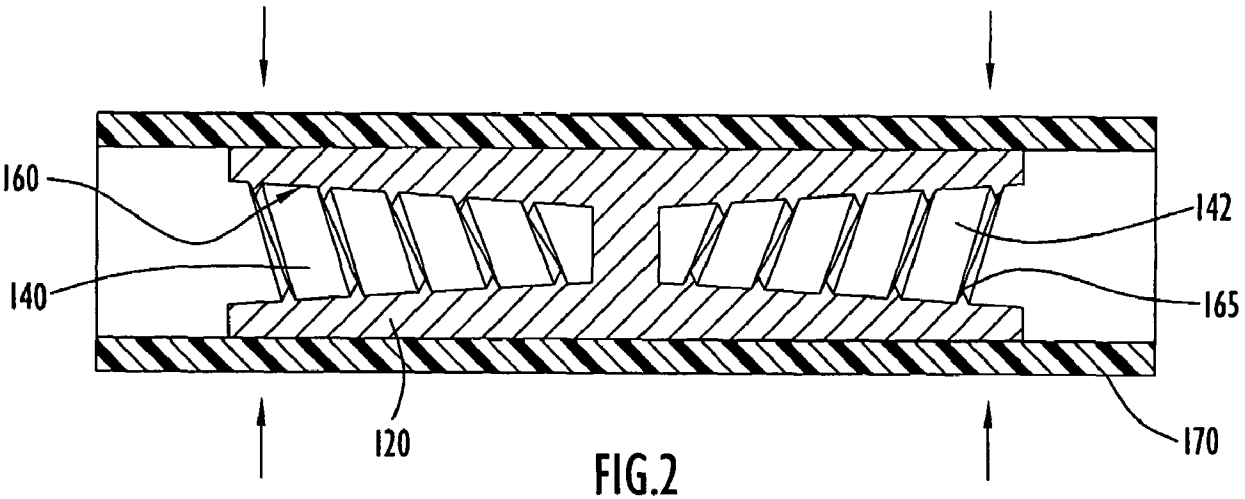
FIG. 2 illustrates a cross sectional view in elevation of the butt (splice) connector of according to the first embodiment of the present invention.

FIG. 2 illustrates a cross sectional view in elevation of the electrical connector 120 of the first embodiment within the insulating sheath 170. As discussed above, the electrical connector 120 includes tapered receiving portions 140, 142. The tapered receiving portions 140, 142 have a funnel or cone shaped interior surface 160 with a decreasing inner diameter as the openings extend toward the center of the connector. The funnel shape of the interior surface 160 can be formed by straight surface walls or by curved surface walls. The straight walls define a linear relationship in the reduction of size of the tapered receiving portions 140, 142 as the cavity extends in a direction from the terminal end 124, 126 to a location proximate the center of the electrical connector 120 near the stop 150. The interior surface can also be curved, e.g., having a generally exponential curvature or the like, such that diameter decreases more rapidly in a direction from the terminal ends 124, 126 to the stop 150. The linear and curved reductions ensure that a conductor can be easily inserted into the relatively large opening at the terminal end 124, 126, while at the same time ensuring that conductors of varying sizes will quickly be wedged in a narrowing, relatively smaller tapered aperture within the receiving portion 140, 142.

The interior surface 160 further include ridges 165 thereon. The ridges 165 may be in the form of spiral or helical threading on the interior surface 160, although the ridges 165 need not have a spiral form. For example, the ridges can include a series of unconnected rings that protrude inward into the cavity or a series of spaced-apart inward projections. More generally, the ridges 165 can have any configuration of inward projections or of an undulating surface that provides surfaces capable of ensnaring strands of a wire conductor or providing a significant frictional force for preventing the wire conductor from easily slipping out of the opening once engaged with the ridges.

Figure 3:
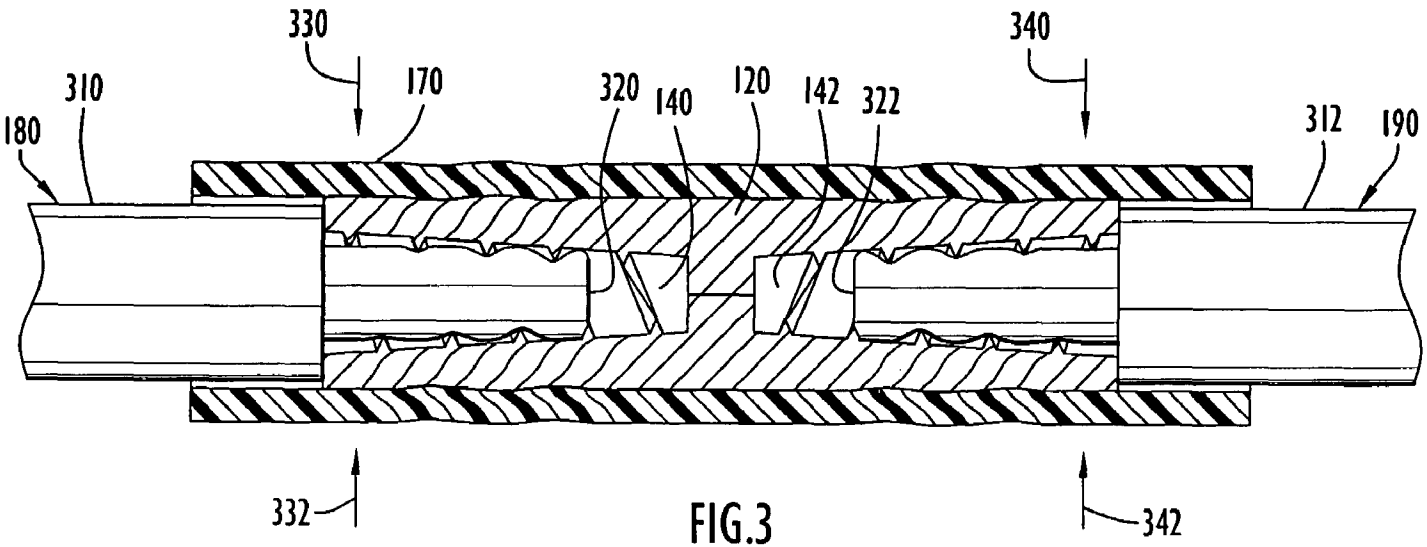
FIG. 3 illustrates a cross sectional view in elevation of the butt connector of the first embodiment with wires inserted into the insulating sheath surrounding the electrical connector.

FIG. 3 illustrates a cross sectional view of the butt connector 100 of the first embodiment of the present invention with wires 180, 190 inserted into the end of the insulating sheath 170. Each wire 180, 190 comprises a copper conductor 320, 322 lined with an external insulation 310, 312. FIG. 3 also shows the external insulator 310, 312 inserted into the insulating sheath 170 and shows the conductors 320, 322 inserted into the insulating sheath 170 and into the tapered receiving portions 140, 142. More specifically, FIG. 3 shows the conductors 320, 322 inserted into the tapered receiving portions 140, 142 to the point where the inner diameter of the tapered receiving portions 140, 142 comes into firm contact with the outer diameter of the conductors 320, 322. The firm connection between the conductors 320, 322 are provided by a frictional interaction between strands of the conductors 320, 322 and inner surfaces 160 of receiving portions 140, 142, as the conductors 320, 322 are wedged into the tapered receiving portions 140, 142. In particular, when the tapered receiving portions 140, 142 include ridges 165 such as threading, the ridges provide additional frictional force or gripping action between the conductors 320, 322 and the electrical connector 120.

As discussed above, the insulating sheathing 170 of the splice connector 100 extends past the end of the electrical connector 120. When the wires 180 and 190 are inserted into the extending ends of the insulating sheath 170, external insulation 310, 312 enters the insulating sheath 170. The insulating sheath 170 overlaps the external insulation 310, 312 to prevent any leakage of current flow from butt connector 100.

After the wires 180, 190 are properly inserted into the butt connector 100, as shown in FIG. 3, such that the conductors 320, 322 are temporarily wedged in the tapered receiving portions 140, 142, the conductors can be permanently connected to the electrical connector 120. Permanent connection of the conductors 320, 322 to the electrical connector 120 is achieved by crimping at least the terminal ends 124, 126 of the electrical connector 120 onto the inserted conductor 320, 322. The crimped state of the electrical conductor 120 is depicted in FIG. 3 via the irregular surface and cross-sectional lines, suggesting that the electrical conductor 120 and the sheathing 170 have been deformed by the crimping process. Any crimping tool that can further restrict the inner diameter of the tapered opening around the wedged conductor 320, 322 can be utilized. Furthermore, when the tapered receiving portions 140, 142 include projections as discussed above, the projections enhance the gripping effect of the crimping between the connector 320, 322 and the electrical connector 120. FIG. 3 shows arrows 330, 332, 340, 342 pointing in the direction of crimping force. The crimping tool can apply crimping force at any point around the circumference of the end of the electrical connector 120 as long as the forces are directed inward toward the conductors 320, 322 to reduce the inner diameter (transverse cross-sectional area) of at least a portion of the receiving portions 140, 142. Optionally, a crimping force can be applied that crushes or collapses the entire connector, rather than just the end portions. In this case, it may be advantageous to configure the center stop as a non-solid member, e.g., as inward projections that block passage of the inserted wires. Thus, the tubular body of the connector provides a permanent electrical connection with the wire conductors only upon at least a portion of the tubular body being crimped, and the tapered shape and inward projections of the receiving portions provide a sufficient frictional force to resist removal of the wire conductors from the receiving portions prior to crimping, without providing a permanent electrical connection between the tubular body and the first wire conductor (i.e., a temporary connection). As used herein, a permanent electrical connection refers to a connection that cannot be broken by a modest force applied by hand to the wiring and that typically meets applicable electrical code requirements for electrical wiring of structures, vehicles, etc. This is to be contrasted with a temporary connection (pre-crimping) that is sufficient to prevent slippage of the connector from the wire(s) due merely to gravity or movement of the wires but that would not withstand a substantial external force such as firm tugging on the wires and would not typically meet electrical code requirements.

Figure 4:
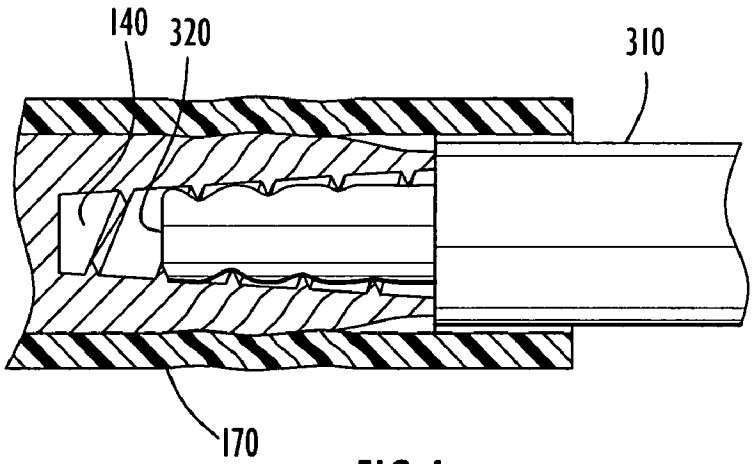
FIG. 4 illustrates a cross sectional view of one end of the butt connector of the first embodiment with the electrical connector crimped permanently to hold the conductor.

FIG. 4 illustrates a cross sectional view of one end of the electrical connector 120 with the crimped end of the electrical connector 120 compressed permanently onto the conductor 320 to hold the conductor 320 within the tapered receiving portion 140. FIG. 4 shows a generally exaggerated form of the terminal ends 124 of the electrical connector 120 after crimping. The tapered opening 140 is collapsed onto the conductor 320 to make frictional contact with the conductors 320. As in FIG. 3, deformation of the conductor is represented in FIG. 4 by irregular an irregular surface and cross sectional lines.

In another scenario (not shown), if the diameter of the external conductors 310, 312 are smaller than the diameter of the tapered receiving portions 140, 142 toward the ends of the electrical conductor 120 (which has the larger diameter), the entire wire 180, 190, including the external insulators 310, 312 will be insertable into the tapered receiving portions 140, 142. In this case, temporary wedge force may be provided between the conductors 320, 322 and the tapered receiving portions 140, 142 and/or between the external insulator 310, 312 and the tapered receiving portions 140, 142. Also in this case, when crimping takes place, the terminal ends 124, 125 may be collapsed over the conductor 320, 322 and the external insulators 310, 312 as long as there is a firm connection between the conductors 320, 322 and the electrical connector 120.

The insulating sheath 170 can be made from any electrically insulating material or any combination of electrically insulating materials (e.g., plastics, rubbers, etc.). In addition, the electrical connector 120 can be made from any electrically conductive material or any combination of electrically conductive materials (e.g., copper, tin, brass, iron, steel, etc.). Furthermore, the conductor can be made in any of the conventional connector sizes and proportions. By way of non-limiting example, the overall length of the insulating sheath 170 can be approximately 1 inch long, and the electrical connector 120 can be approximately ¾ of an inch long, resulting in an overlap on each end of about ⅛ of an inch. The central stop 150 can be about 1/16 of an inch thick, such that cavities 140, 142 are slightly less than ⅜ of an inch in length. The inner diameter or inner circumference of receiving portions 140, 142 can be sized to work with wires of a particular gauge, e.g., 14 gauge wire, or a range of gauges. In general, the invention is not limited to any particular dimensions, and any dimensions suitable for a particular application are considered to fall within the scope of the invention.

Figure 5:
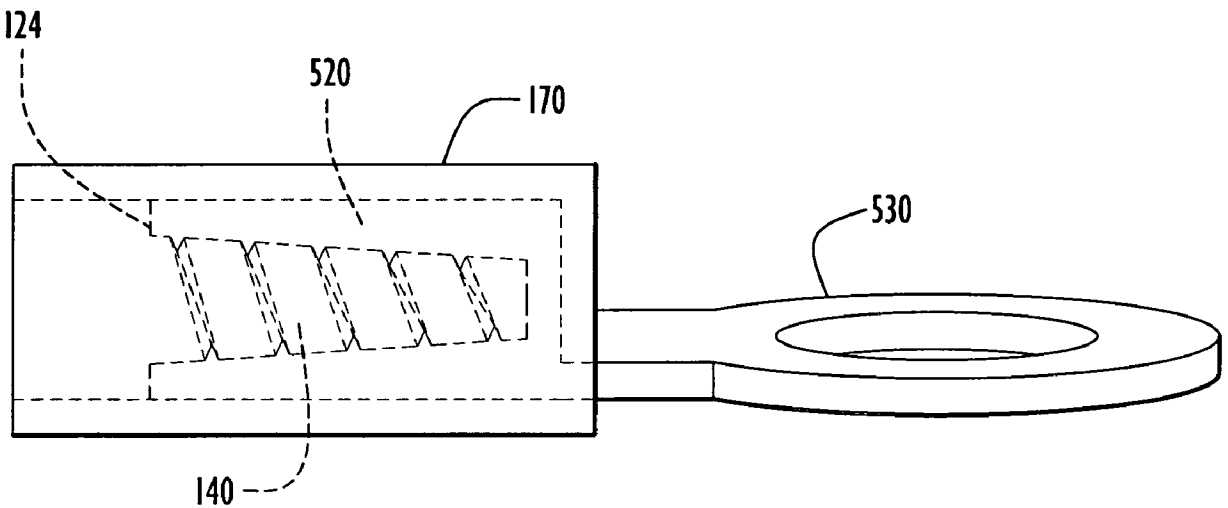
FIG. 5 illustrates a perspective view of a ring connector configured with a tapered, ridged terminal and an electrical termination eye according to an exemplary second embodiment of the present invention.
Figure 6:
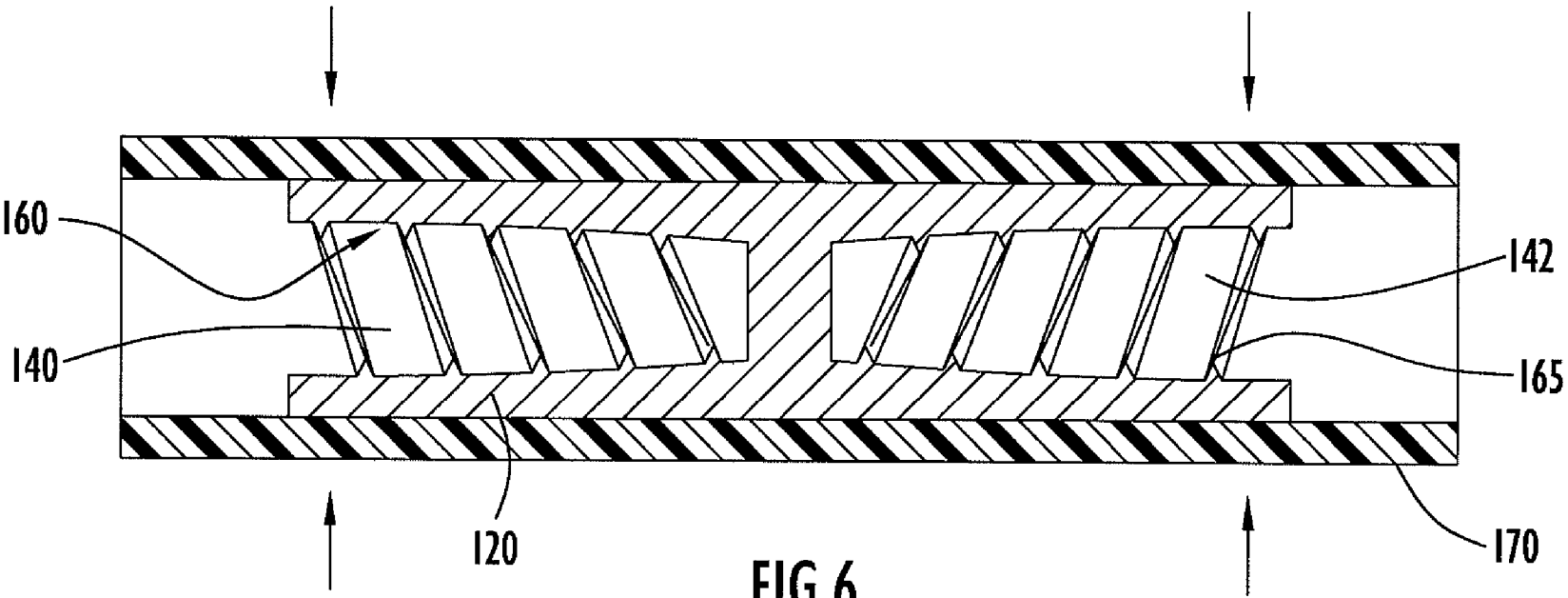
FIG. 6 illustrates a cross sectional view in elevation of the butt (splice) connector according to the first embodiment of the present invention having a receiving portion with a curved profile.

FIG. 5 illustrates a perspective view of an electrical ring connector 520 according to a second exemplary embodiment of the present invention, shown configured with an electrical termination eye 530. This embodiment of the invention illustrates how the invention can be used in other situations where it would be useful to secure a conductor of a wire to a component or terminal designed to receive a washer-like ring connector. Typically, such a ring connector slides over a threaded bolt or screw and is secured by screwing a nut down onto the bolt into firm contact with the ring connector. One side of the connector 520 shown in FIG. 5 is essentially the same as one side of the connector of the first embodiment, and a wire conductor can be connected to this end of connector 520 in the same manner previously described in the first embodiment. Specifically, a conductor can be inserted into the tapered receiving portion 140 until a temporary gripping force is achieved via the tapered shaped of the cavity and engagement of the strands of the wire with the inward projecting ridges. The terminal end 124 of the electrical connector 520 is then be crimped to permanently secure the conductor to the tapered receiving portion 140 of the electrical connector 520. The electrical termination eye 530 is conductively connected to the end of connector 530 that receives the wire conductor, such that current can flow through the wire to electrical termination eye 530 and ultimately to the connected terminal or equipment to which eye 530 is coupled.

It is intended that the present invention cover the modifications and variations of this invention that come within the scope of the appended claims and their equivalents. For example, it is to be understood that terms such as "left", "right" "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration.

Having described preferred embodiments of new and improved electrical wire connector, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. An electrical connector, comprising:

a crimpable tubular body including a first receiving portion for receiving a first wire conductor via a first opening at a first longitudinal end of the tubular body, the tubular body having a cylindrical outer profile with a constant transverse cross-sectional outer diameter, the tubular body providing a permanent electrical connection to the first wire conductor only upon at least a portion of the tubular body being crimped;

wherein the first receiving portion has a tapered portion with a transverse cross-sectional area that diminishes inward of the first longitudinal end and includes inward projections disposed along an extent of the tapered portion for engaging the first wire conductor, the tapered shape and inward projections providing a sufficient frictional force to resist removal of the first wire conductor from the first receiving portion prior to crimping, without providing a permanent electrical connection between the tubular body and the first wire conductor.

2. The electrical connector of claim 1, wherein the inward projections comprise ridges.

3. The electrical connector of claim 1, wherein the inward projections comprise threading.

4. The electrical connector of claim 1, further comprising a stop member at an inward end of the first receiving portion for limiting insertion of the first wire conductor into the tubular body.

5. The electrical connector of claim 4, wherein the stop is a solid member.

6. The electrical connector of claim 1, wherein the first receiving portion is tapered in a linear manner.

7. The electrical connector of claim 1, wherein the first receiving portion is tapered in a curved manner.

8. The electrical connector of claim 1, further comprising an insulating sheath covering the tubular body.

9. The electrical connector of claim 1, wherein the crimpable tubular body further including a second receiving portion for receiving a second wire conductor via a second opening at a second longitudinal end of the tubular body, wherein the second receiving portion has a tapered shape with a transverse cross-sectional area that diminishes inward of the second longitudinal end and includes inward projections for engaging the second wire conductor, the tapered shape and inward projections providing a sufficient frictional force to resist removal of the second wire conductor from the second receiving portion prior to crimping, without providing a permanent electrical connection between the tubular body and the second wire conductor.

10. The electrical connector of claim 1, further comprising an annular ring disposed at a second longitudinal end of the tubular body.

* * * * *